United States Patent [19]

Knirsch

[11] 4,436,801

[45] Mar. 13, 1984

[54] ELECTROPHOTOGRAPHIC RECORDING ELEMENT HAVING AN ANILINE SULPHONEPHTHELEIN CHARGE GENERATOR

[75] Inventor: Franco Knirsch, Banchette, Italy

[73] Assignee: Ing. C. Olivetti & C., S.p.A., Ivrea, Italy

[21] Appl. No.: 451,387

[22] Filed: Dec. 20, 1982

[30] Foreign Application Priority Data

Dec. 21, 1981 [IT] Italy ..... 68649 A/81

[51] Int. Cl.[3] ..... G03G 5/06; G03G 5/14

[52] U.S. Cl. ..... 430/73; 430/58

[58] Field of Search ..... 430/58, 73, 74, 75

[56] References Cited

U.S. PATENT DOCUMENTS

| | | | |
|---|---|---|---|
| 4,025,341 | 5/1977 | Rule | 430/75 |
| 4,111,693 | 9/1978 | Wright et al. | 430/73 |
| 4,175,961 | 11/1979 | Wright et al. | 430/74 |

*Primary Examiner*—John E. Kittle
*Assistant Examiner*—John L. Goodrow
*Attorney, Agent, or Firm*—Schuyler, Banner, Birch, McKie & Beckett

[57] ABSTRACT

The electrophotographic recording element comprises a charge generator compound formed from aniline sulphonephthelein derivatives, in which at least one phenyl ring comprises an amino group substituted by an aromatic or heterocyclic group. The recording element may consist of an electrically conducting support on which a layer is deposited containing the charge generator compound dispersed in a resin, then covered in its turn by a further electric charge transporter layer containing an oxadiazole derivative in solid solution in a resin. The recording element has high sensitivity to luminous radiation over a range extending from visible radiation to infrared, and can consequently be used in normal copying machines and especially in laser printers operating with a wavelength up to about 850 nm. According to a further version of the invention, the recording element comprises an electroconducting layer on which a single layer is deposited formed from a mixture prepared from a dispersion of an aniline sulphonephthalein derivative in a resin, and a solid solution of oxadiazole derivative.

11 Claims, No Drawings

ELECTROPHOTOGRAPHIC RECORDING ELEMENT HAVING AN ANILINE SULPHONEPHTHELEIN CHARGE GENERATOR

BACKGROUND OF THE INVENTION

This invention relates to an electrophotographic recording element comprising an electrically conducting support and a film of photoconductor material containing an organic electric charge generator compound derived from aniline sulphonephthalein. Recording elements for electrophotographic reproduction are known, in which a first layer, in contact with an electroconducting support, is formed from electric charge generator compounds based on pyrilium salts, and a second layer, superposed on the first, is formed from organic substances, the function of which is to transport the electric charges.

Such recording elements have certain drawbacks which limit their use, such as: very low sensitivity in the infrared radiation range; the need to use sophisticated and very costly spreading apparatus such as vacuum evaporators; poor mechanical strength of the films produced, with consequent surface deterioration during the development and transfer cycles; low photochemical stability to ozone and heat, with consequent reduction of the life of the photoconducting element with increase in the memory effect; and high toxicity of some of the compounds used. Sulphonephthalein derivatives are known as pH indicators and as single layer zinc oxide photoconductor sensitisers.

The sulphonephthalein derivatives used for sensitising zinc oxide are poorly soluble in the common solvents used in preparing electrophotographic zinc oxide paints, with the result that there is considerable difficulty in spreading a single photoconducting layer to perform both the functions of generating and transporting the electric charges.

Moreover, these photoconductors have very low sensitivity in the infrared radiation range.

SUMMARY OF THE INVENTION

The technical problem which the present invention proposes to solve is to provide an electrophotographic recording element having high spectral sensitivity extending from visible radiation to the infrared region, and excellent resistance to abrasion, ageing, light, ozone and heat.

The recording element according to the invention is used in electrophotographic reproduction apparatus in the form of a film containing the aniline sulphonephthalein derivative spread either on a drum, on a belt or on individual support sheets, to provide a large number of copies without showing any decline in the quality of the copies made. In particular, the recording element according to the invention is suitable for high-speed electrophotographic printers using as their light source laser beam generators with a wavelength up to about 850 nm.

The said technical problem is solved by the recording element according to the invention, which comprises an electrically conducting support, and a film of photoconductor material containing an electric charge generator compound, said charge generator compound comprising a sulphonephthalein derivative in which at least one phenyl ring comprises a substituted amino group in which at least one substituent is an aromatic or heterocyclic ring.

This and further characteristics will be apparent from the description given hereinafter, by way of non-limiting example, of a preferred type of formulation and the relative manufacturing process.

DETAILED DESCRIPTION OF THE PREFERRED EMBODIMENT

The electrophotographic recording element according to a first aspect of the present invention comprises an electrically conducting support in the form of a thin sheet of suitable material, carrying a first layer of light-sensitive organic material for the purpose of generating electric charges when struck by the light. A second transparent charge transporter layer, covering the first layer, performs the function of transferring the electric charges generated by the first layer. In this context, a conducting support is any material which by its nature or by treatment is able to conduct electric current. Conducting supports suitable for the present invention can be metal sheets, such as aluminium sheets or plastics sheets metallised with aluminium, gold, copper, zinc, cadmium, nickel etc., or made conducting by means of paints based on carbon black, graphite, quaternary nitrogen salts, or copper iodide. The conducting support can carry an anti-injection barrier layer having a thickness less than 1 μm formed from a metal oxide or a natural or synthetic resin.

The electric charge generator layer comprises compounds based on sulphonephthalein, and more particularly is constituted by aniline sulphonephthalein derivatives.

The aniline sulphonephthalein derivatives suitable for forming the charge generator layer according to the invention are used in the form of a dispersion of the aniline sulphonephthalein derivatives in a vehicle in which they can be either totally or partially insoluble. The dispersing vehicle can be a synthetic or natural resin, as stated hereinafter. The aniline sulphonephthalein derivatives used for forming the charge generator layer according to the invention are represented by the following general formula:

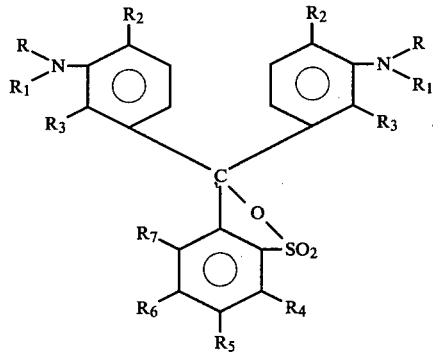

where the groups R and $R_1$, which are the same or different, can be:

(a) a hydrogen atom;

(b) an alkyl group of 1 to 18 carbon atoms, such as methyl, ethyl, butyl, propyl or isopropyl, either substituted or not;

(c) an acid group esterified in any manner;

(d) an aromatic, heterocyclic or alicyclic group such as benzene, naphthalene, anthracene, vinylbenzene, pyridine, carbazole, indole or benzothiophene, either unsubstituted or substituted to a lesser or greater degree by (b) or by (e) a halogen atom;

(f) an electron acceptor group such as $-NO_2$, $-NO$, $-CN$, $-CF_3$, $-SO_2F$,

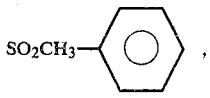

$COCH_3$ etc.;

(g) a hydroxy or alkoxy group;

(h) an amino group;

(i) an amide group;

(l) an acid group or its respective ester with aliphatic or aromatic alcohols;

(m) a radical deriving from a cyclic amine, such as morpholine, piperidine etc.

The groups $R_2$, $R_3$, $R_4$, $R_5$, $R_6$ and $R_7$ can be chosen from the radicals (a), (b), (c), (d), (e), (f), (g), (h), (i), (l) or (m).

The charge generator layer is prepared by forming a paint in which the aniline sulphonephthalein derivative is dispersed in a suitable dispersing vehicle, in which it can be either totally or partially insoluble.

Said suitable dispersing vehicle can be chosen from aromatic hydrocarbons, esters such as ethyl acetate, butyl acetate etc., or chlorinated solvents.

Use can also be made of mixtures of the aforesaid dispersing vehicles with resins, so as to improve the adherence of the layer to the support, and to obtain a paint with chemical-physical characteristics which enable it to be more easily prepared.

By way of non-limiting example, the resin used can be chosen from polyvinyl-formals, acrylic resins, polyvinylchloride/polyvinylacetate copolymers, polyvinyl chloride and polyvinyl acetate, maleic acid, polyesters etc. The particle size of the aniline sulphonephthalein derivative must be as fine as possible, and preferably between 0.1 and 1 μm.

Such particle sizes are easily attained by grinding with mills of the steel or glass ball type, or with apparatus known to the experts of the art.

By suitably choosing the dispersing mixtures and the liquid medium in which the grinding of the aniline sulphonephthalein derivative is to be carried out, it is easy to obtain a particle size of less than 1 micron.

In this respect, it has been found that the sensitivity to infrared radiation increases for aniline sulphonephthalein derivative particle sizes less than 1 micron.

The thickness of the generator layer can vary from 0.1 μm to 5 μm, with a density of 0.1–5 grams per $m^2$ of support. In preparing the resin containing the charge generator, the weight ratio of the derivative to the dispersing vehicle can vary from 100 parts of derivative and zero parts of dispersant, to 20 parts of derivative and 80 parts of dispersant. In particular, the charge generator layer can also be prepared in the absence of the resins mixed with the dispersing vehicle. In this case, the charge generator layer can also be prepared by vacuum evaporation methods known in the art.

As stated, a charge transporter layer is superposed on the charge generator layer.

The charge transporter layer is formed from a solid solution of a charge transporter compound in a liquid. The charge transporter layer must be transparent to incident light, to enable the light to reach the underlying charge generator layer.

Any synthetic or natural resin having good insulating power and good mechanical characteristics can be used as the binder. The preferred resins are the polycarbonates, silicone resins, polyesters, acrylic resins or polyurethanes, either reactive or not.

The charge transporter compound used can be any easily soluble and stable charge transporter compound known in the art. The choice of the particular charge transporter compound must be made on the basis of the type of polarisation used.

In particular:

(A) If positive polarisation of the recording element is used, for example by means of a device of the positive charge corona effect type, a charge transporter compound must be used which conducts by electrons, i.e. of n type, such as 2,4,7-trinitrofluorenone, or generally a compound comprising electron acceptor groups.

(B) If negative polarisation is used, a charge transporter compound must be used which conducts by holes, i.e. of p type, or generally a compound comprising electron donor groups, such as triarylmethane, triphenylamine, pyrazoline, oxadiazole, imidazole, triazole, oxazole etc.

In particular, for preparing the recording element according to the invention, 2,5-bis(p-diethylaminophenyl)-1,3,4-oxadiazole can be used as the charge transporter.

The transporter layer can also contain sensitisers of the type known to experts of the art, plasticisers, levelling agents, adhesive agents etc.

The thickness of the transporter layer can vary from 3 μm to 30 μm, depending on the type of transporter used, the type of binder used, the ratio of transporter to binder, and the thickness of the generator layer.

The aniline sulphonephthalein derivatives used in the present invention can be synthesised by the method described by Schwarzenbach, Ott and Hagger in Helvetia Chimica Acta 1937 Vol. 20, page 498, Schwartzenbach and Ott in Helvetia Chimica Acta 1937 Vol. 20, page 627, and by Mohler, Forster and Schwarzenbach in Helvetia Chimica Acta 1937 Vol. 20, page 653.

According to a further aspect of the present invention, the electrophotographic recording element can be prepared by forming a single layer of photoconductor material which performs both the charge generation and charge transport functions. In this case, an electroconducting support of the type described heretofore is covered by a film formed from a mixture of an organic charge generator compound comprising aniline sulphonephthalein, a charge transporter compound, and a binder.

Again in this case, the new aniline sulphonephthalein derivative is dispersed in a dispersing vehicle chosen from those stated heretofore.

The charge transporter compound can be any charge transporter compound containing at least one electron donor group, a non-limiting example of which is 2,5-bis(p-diethylaminophenyl)-1,3,4-oxadiazole, in solid solution in a binder of the type indicated heretofore with reference to the double layer recording element.

Some non-limiting examples of preparation of the recording elements according to the invention are described hereinafter.

EXAMPLE 1

3 g of N-phenyl-anilinesulphonephthalein are ground for 12 hours in 500 g of ethylacetate by means of a steel ball mill. 1 g of Vinylite WMCH (tripolymer of vinyl chloride, vinyl acetate and maleic acid produced by Union Carbide Co.) dissolved in 50 g of n-butylacetate is added to the dispersion obtained in this manner.

Machining is continued for a further 12 hours, and the paint obtained is spread on a sheet of aluminised polyester to form a film having a density of 0.38 g/m$^2$.

After drying, the charge generator layer is covered with a transporter layer having a thickness of 5 microns, prepared by the following formulation: 2,5-bis(diethylaminophenyl)-1,3,4-oxadiazole, 40 g; Lexan 145 (polycarbonate produced by General Electric), 60 g; chloroform, 700 g.

In this manner, a first light-sensitive electrophotographic recording element according to the invention is obtained, and is tested by the following two procedures:

(a) charging it with a negative corona by exposing it through a grey scale to a light source and developing it with an appropriate toner.

The light source is a Bausch-Lomb model 33-82-02 monochromator with a 45 Watt tungsten-halogen lamp, at a distance of 1 meter from the grey scale. Using monochromatic light of 633 nm and 750 nm, excellent reproduction of the grey scale with an exposure of 1 second is obtained for the sample concerned.

(b) a sample of the recording element according to the invention is placed on a mobile plate, and is charged by a negative corona of approximately −6 KV (distance between corona and sample, 5.5 mm).

The sample is then halted under a measuring station comprising an electrometer with a transparent probe (ISOPROBE® model 144 S1 of Monroe Electronics) and a He-Ne laser source of 633 nm wavelength and 5 mWatt power, fitted with a shutter. The charge intensity and the discharge curve under light can be recorded or read, either on an oscilloscope or by means of a recording device.

For the sample concerned, the charge potential Vo is 500 V. Halving of the potential Vo is obtained with an energy of 5μ Joules.

EXAMPLE 2

5 g of N-ethyl-anilinesulphonephthalein are ground in 70.4 g of n-butylacetate by means of a steel ball mill for the time necessary to obtain a particle size of 0.2 μm.

5 g of vinyl chloride/acetate copolymer containing a very small quantity of unsaturated dicarboxylic acid, known as Hostaflex M 131 produced by Farbwerke Hoechst Ag. Frankfurt, 36 g of butylacetate and 8.6 g of toluene are added to the dispersion obtained in this manner.

Grinding is continued, and 9.9 g of ethylacetate and 8.8 g of butylacetate are added to the paint thus obtained.

The resultant paint is spread on a sheet of aluminised polyester to a density of 0.38 g/m$^2$.

After drying, the charge generator layer is covered with a transporter layer of thickness 8 microns, prepared by the following formulation:

5 g of 2,5-bis(diethylaminophenyl)-1,3,4-oxadiazole;
5 g of Lexan 145 (polycarbonate produced by General Electric);
52.8 g of dichloromethane.

The test on the second recording element obtained in this manner is carried out by the following procedure.

The element is placed on a mobile plate, and is charged by a negative corona of −5800 V (distance between corona and sample, 5.5 mm).

The element charged in this manner is halted under a measuring station comprising an electrometer with transparent probe (Isoprobe mod. 144 S1 of Monroe Electronics) and a light source consisting of a Bausch-Lomb monochromator model 33-86-02 fitted with a shutter. This source is used both for the determinations with monochromatic light, and for the determinations with white light, by suitably excluding the monochromator diffraction grating.

The charge intensity and the discharge curve under light are memorised and recorded.

For the sample concerned, the charge intensity Vo is 450 V, and E/2 (halving energy) is 2 μJ/cm$^2$ (at 633 nM), 6 μJ/cm$^2$ (at 750 nm), and 10 Lux sec. (white light).

EXAMPLE 3

The generator layer is prepared as in Example 2, but using N-(p-sulphomethylphenyl)-anilinesulphonephthalein as the anilinesulphonephthalein derivative. The E/2 values, obtained under the same conditions as Example 2, are 3.5 μJ/cm$^2$ (633 nm), 9 μJ/cm$^2$ (750 nm) and 15 Lux sec.(white light) respectively.

EXAMPLE 4

The generator layer is prepared as in Example 2, but using N-[p-(carboxylmethylester)phenyl]-anilinesulphonephthalein as the anilinesulphonephthalein derivative. The E/2 values, obtained under the same conditions as Example 2, are 2.5 μJ/cm$^2$ (633 nm), 7 μJ/cm$^2$ (750 nm) and 12 Lux sec. (white light) respectively.

EXAMPLE 5

10 g of N-phenylanilinesulphonephthalein prepared as in Example 1 are added to 10 g of charge transporter as described in Example 1, and the mixture homogenised on a laboratory turntable for 1 hour.

The paint obtained in this manner is spread on a sheet of aluminised polyester to a density of about 11 g/m$^2$.

In this manner, a recording element according to the invention is obtained, formed from a single light-sensitive layer.

The E/2 values obtained under the same conditions as Example 2 are 4 μJ/cm$^2$ (633 nm), 10 μJ/cm$^2$ (750 nm), and 15 Lux sec. (white light) respectively.

I claim:

1. An electrophotographic recording element comprising an electrically conducting support, and a film of photoconductor material containing an electric charge generator compound, said charge generator compound comprising a sulphonephthalein derivative in which at least one phenyl ring comprises a substituted amino group in which at least one substituent is an aromatic or heterocyclic ring.

2. A recording element as claimed in claim 1, wherein said film is formed from a first layer comprising the charge generator compound, and a second layer superposed on the first and containing a solid solution of a charge transporter compound in a resin.

3. A recording element as claimed in claim 1, wherein said film is formed from a single layer comprising a mixture of the said sulphonephthalein derivative and a solid solution of a charge transporter compound in a resin, whereby the electric charge generation and transport functions are performed simultaneously by the said single layer.

4. A recording element as claimed in claim 1, wherein said sulphonephthalein derivative is an aniline sulphonephthalein derivative represented by the following formula:

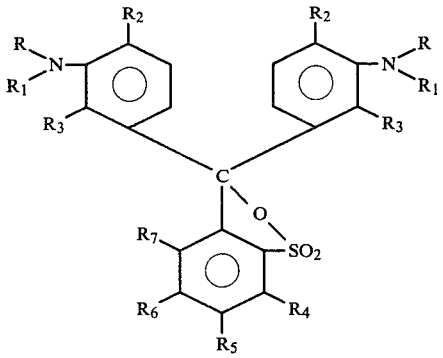

where R and $R_1$, which may be the same or different, are:

(a) a hydrogen atom;
(b) an alkyl group, substituted or not, containing 1 to 18 carbon atoms;
(c) an acid radical which may be esterified;
(d) an aromatic, heterocyclic or alicyclic radical, either unsubstituted or substituted with (b) or with;
(e) a halogen atom;
(f) an electron acceptor radical;
(g) an hydroxy or alkoxy radical;
(h) an amine radical;
(i) an amide radical;
(l) an aliphatic or aromatic alcoholic ester;
(m) a radical derived from a cyclic amine and $R_2$, $R_3$, $R_4$, $R_5$, $R_6$ and $R_7$ are selected from any of the foregoing radicals (a) to (m).

5. A recording element as claimed in claim 4, wherein said electron acceptor radical (f) is selected from the groups $—NO_2$, —NO, —CN, $—CF_3$, $—SO_2F$, $SO_2—$,

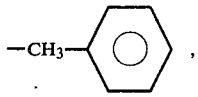

or $—COCH_3$.

6. A recording element as claimed in claim 4, wherein said acid radical (c) is selected from —COOH or $—SO_3H$, or the corresponding aliphatic or aromatic alcoholic esters.

7. A recording element as claimed in claim 4, wherein said aromatic or heterocyclic radical (d) is benzene, naphthalene, anthracene, vinylbenzene, pyridine, carbazole or indole.

8. A recording element as claimed in claim 1 wherein said sulphonephthalein derivative is dispersed in a dispersing vehicle in which it is preferably totally or partially insoluble.

9. A recording element as claimed in claim 8, wherein said vehicle is a synthetic or natural resin chosen from polyvinyl-formals, acrylic resins, polyvinylchloride/polyvinylacetate copolymers, polivinylchloride, polyvinylacetate, maleic acid resins or polyesters.

10. A recording element as claimed in claim 2, wherein said charge transporter compound contains at least one electron donor group.

11. A recording element as claimed in claim 2 wherein said charge transporter compound comprises a solid solution of 2,5-bis(p-diethylaminophenyl)-1,3,4-oxadiazole in a resin chosen from polycarbonates, polyesters, polyurethanes either reactive or not, silicone resin, or acrylic resin.

* * * * *